US007544029B2

(12) United States Patent
Cobene, II et al.

(10) Patent No.: US 7,544,029 B2
(45) Date of Patent: Jun. 9, 2009

(54) APPARATUS AND METHOD FOR ATTACHING A COVER TO AN ASSEMBLY OF SHEETS

(75) Inventors: Robert L. Cobene, II, Santa Clara, CA (US); Daniel Steven Kline, Encinitas, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1276 days.

(21) Appl. No.: 10/231,037

(22) Filed: Aug. 30, 2002

(65) Prior Publication Data

US 2004/0057814 A1 Mar. 25, 2004

(51) Int. Cl.
*B42C 11/04* (2006.01)

(52) U.S. Cl. ..... 412/4; 412/8; 412/11; 412/14; 412/19; 412/22; 412/33; 270/52.18; 270/58.09

(58) Field of Classification Search ..... 412/1, 412/3–5, 8–9, 11, 19, 22–23, 33, 14; 270/52.18, 270/57.08, 58.08, 58.09, 58.07
See application file for complete search history.

(56) References Cited

U.S. PATENT DOCUMENTS

| | | | | |
|---|---|---|---|---|
| 4,077,078 | A | 3/1978 | Snellman et al. | |
| 4,150,453 | A | 4/1979 | Vaughn | |
| 5,044,857 | A | 9/1991 | Crudo | |
| 5,052,872 | A | 10/1991 | Hunder et al. | |
| 5,078,425 | A | 1/1992 | Crudo | |
| 5,193,962 | A | 3/1993 | Parker et al. | |
| 5,346,350 | A | 9/1994 | Luhman et al. | |
| 5,536,044 | A | 7/1996 | Luhman et al. | |
| 6,000,894 | A | 12/1999 | Suzuki et al. | |
| 2005/0011610 | A1 * | 1/2005 | Cobene | 156/308.2 |

FOREIGN PATENT DOCUMENTS

| | | |
|---|---|---|
| DE | 580 961 | 7/1933 |
| DE | 15 36 485 | 3/1972 |
| DE | 100 15 485 | 10/2001 |
| WO | WO 99/11469 | 3/1999 |
| WO | WO 99/38707 | 8/1999 |
| WO | WO99/38797 | 8/1999 |

* cited by examiner

*Primary Examiner*—David P Bryant
*Assistant Examiner*—Eric A Gates

(57) ABSTRACT

The present invention is generally directed to an apparatus and method for attaching a cover to an assembly of plural sheets. Exemplary embodiments include first and second clamping components displaceable relative to one another, wherein the first and second clamping components define a first dimension of a sheet receiving volume, and wherein a second dimension of the sheet receiving volume is defined by a sheet stop and a first plane that is orthogonal to the first and second clamping components; and a roller drive for displacing a first roller along the first plane and exerting a force perpendicular to the first plane in a direction toward the sheet receiving volume.

19 Claims, 12 Drawing Sheets

APPARATUS AND METHOD FOR ATTACHING A COVER TO AN ASSEMBLY OF SHEETS

BACKGROUND

1. Field of the Invention

Figure 1:
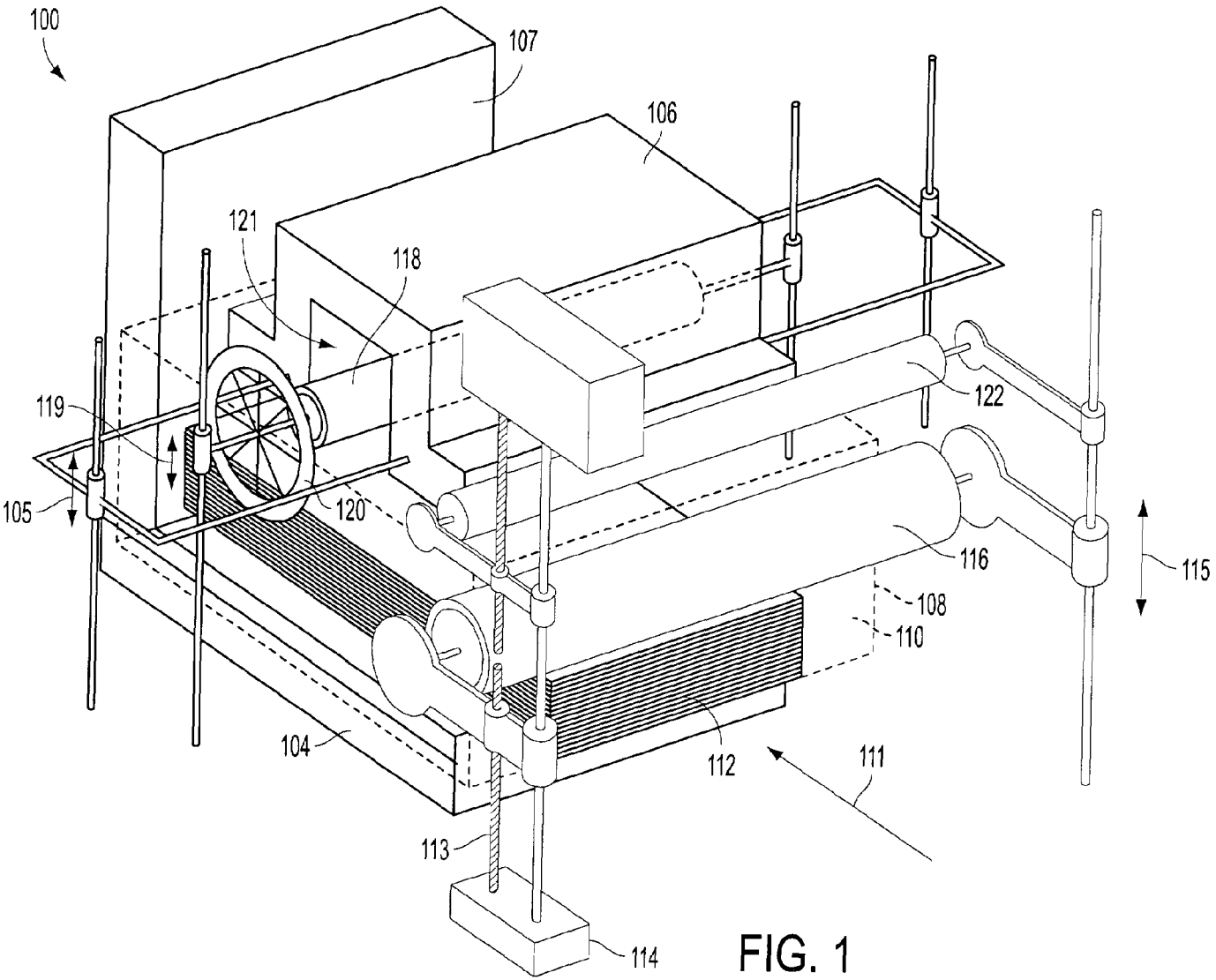

The present invention relates generally to the manufacture of books, pamphlets or other types of bound works. More particularly, the present invention is directed to an apparatus and method for attaching a cover to an assembly of plural sheets.

2. Background Information

Today, a variety of different bookbinding systems can deliver professionally bound documents, including books, manuals, publications, annual reports, newsletters, business plans and brochures. A bookbinding system generally can be classified as a commercial (or trade) bookbinding system that is designed for in-line manufacturing of high quality volume runs or an in-house (or office) bookbinding system designed for short "on demand" runs. Commercial bookbinding systems generally provide a wide variety of binding capabilities in terms of sizes of books, but require large production runs (e.g., on the order of thousands of books) to offset the set-up cost of each production run and to support the necessary investment in automatic in-line production equipment. Office bookbinding systems, on the other hand, generally involve manual intervention and provide relatively few binding capabilities, but are significantly less expensive to set up and operate than commercial bookbinding systems, even for short on-demand production runs of only a few books.

In general, a bookbinding system collects a plurality of sheets (or pages) into a text body (or book block) that includes a spine and two hinge areas. The bookbinding system applies an adhesive to the text body spine to bind the sheets together. A cover may be attached to the bound text body by an adhesive on the side hinge areas or the spine of the text body, or both. Generally, the cover of a commercial soft cover book is attached to the text spine. The covers of hardcover books and some soft cover "lay flat" books, on the other hand, are not attached to the text body spines (i.e., the spines are floating).

The covers are typically attached by exerting force or force against the spine area of the cover using a planar component. For example, a system for bookbinding is described in an International Patent Application number PCT/US99/00265 by Marsh that was published on Aug. 5, 1999 as International Publication No. WO 99/38707, which is hereby incorporated by reference in its entirety. In the Marsh application, a cover with an adhesive strip disposed along a spine area is positioned across a pair of pressing rollers to form a pocket with the spine area at the bottom. A text body is inserted into the pocket so that edges of the text body are in contact with the adhesive strip. The pressing rollers are moved forcibly toward one another compress the cover firmly against the front and back sides of the text body and to compress the text body together tightly adjacent to the spine area. A sonic tool transmits sonic energy (i.e., vibratory pressure) through the spine area of the cover to activate the adhesive strip, thereby binding the text body and the cover into a bound book.

SUMMARY OF THE INVENTION

In accordance with exemplary embodiments of the present invention, an apparatus for attaching a cover to an assembly of plural sheets is provided, including first and second clamping components displaceable relative to one another, wherein the first and second clamping components define a first dimension of a sheet receiving volume, and wherein a second dimension of the sheet receiving volume is defined by a sheet stop and a plane that is orthogonal to the first and second clamping components, and a roller drive for displacing a first roller along the first plane and exerting a force perpendicular to the first plane in a direction toward the sheet receiving volume.

Also in accordance with exemplary embodiments of the present invention, a method for attaching a cover to an assembly of plural sheets is provided, including the steps of positioning the assembly of plural sheets within a sheet receiving volume defined, at least in part, by first and second clamping components, the assembly of plural sheets including a first edge; delivering a first flap of the cover from a feed point into the sheet receiving volume such that the first flap is received by a first side of the assembly of plural sheets; clamping the assembly of plural sheets and the first flap with the first and second clamping components; and displacing a first roller along a first plane of the sheet receiving volume such that a spine of the cover is pressed against the first edge, wherein the first plane is positioned orthogonal to the first and second clamping components.

BRIEF DESCRIPTION OF THE DRAWING FIGURES

Other objects and advantages of the present invention will become apparent to those skilled in the art upon reading the following detailed description of preferred embodiments, iri conjunction with the accompanying drawings, wherein like reference numerals have been used to designate like elements, and wherein:

FIG. 1 is a perspective view of an exemplary embodiment depicting an apparatus for attaching a cover to an assembly of plural sheets.

Figure 2:
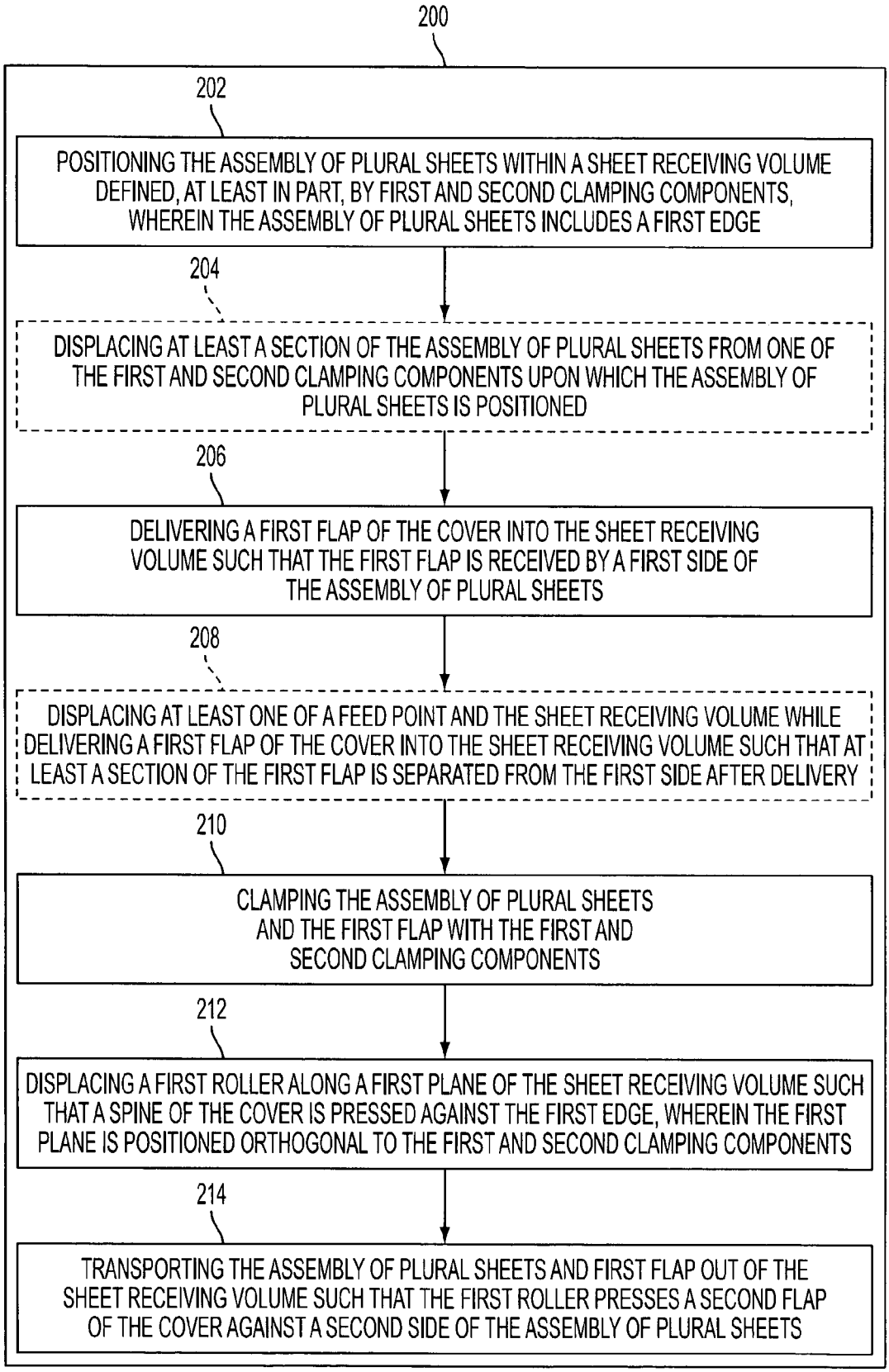

FIG. 2 describes exemplary embodiments of steps for attaching a cover to an assembly of plural sheets as a flowchart.

FIGS. 3*a*-3*f* are partial cross-sectional representational views of the apparatus in the exemplary embodiment of FIG. 1 for illustrating steps in the exemplary embodiment of FIG. 2.

FIGS. 4*a*-4*d* are partial cross-sectional representational views of another exemplary embodiment of an apparatus for illustrating steps described in the exemplary embodiment of FIG. 2.

DETAILED DESCRIPTION OF THE PREFERRED EMBODIMENTS

An apparatus 100 for attaching a cover to an assembly of plural sheets is illustrated in the exemplary embodiment of FIG. 1. As referenced herein, a "plural assembly of sheets" refers to either a bound text body (i.e., a stack of pages with edges adhered together) or unbound text body (i.e., a stack of pages with no binding adhesive). A plural assembly of sheets, such as the text body 112 in the exemplary embodiment of FIG. 1, does not necessarily have to be bound prior to attaching the cover. The same adhesive used in attaching the cover can also be used to bind the assembly of plural sheets together. The apparatus 100 can be implemented in a desktop or office bookmaking system (e.g., designed to satisfy on-demand bookbinding needs), in a mass-production setting, or in any other system where the attachment of a cover to a text body is desired.

Exemplary embodiments include first and second clamping components displaceable relative to one another. For example, the apparatus of FIG. 1 includes a lower clamp 104 and an upper clamp 106. The upper clamp 106 is movable 105 relative to the lower clamp 104 in a manual manner. In the alternative, mechanical mechanisms or other types of devices used in mechanical actuation can be used to move one of or both the lower clamp 104 and the upper clamp 106.

The first and second clamping components (e.g., 104 and 106) of the exemplary embodiment of FIG. 1 define a dimension of a sheet receiving volume. For example, the text body 112 is between the lower clamp 104 and the upper clamp 106. Thus, the distance between the lower clamp 104 and the upper clamp 106 defines a dimension of the space 108. Another dimension of a sheet receiving volume (e.g. space 107) is defined between a sheet stop (e.g., jog 108) and a plane (e.g., side 110) that is orthogonal to the first clamping component (e.g. lower clamp 104) and (e.g. upper clamp 106) second clamping component. As shown in FIG. 1, the text body 112 is stacked against or placed against a jog 107 in a direction 111. A side 110 of the space 108 that contains or receives the text body 112 can be at a position defined by the size of the text body 112 in a direction 111 toward the jog 107. More particularly, the side 110 can be along the edge of the text body, which will receive the spine portion of a cover.

Exemplary embodiments include a roller drive for displacing a first roller along the plane and exerting a force perpendicular to the plane in a direction toward the sheet receiving volume. For example, FIG. 1 shows a screw rod 113 for moving a binding roller 116 along the side 110 along a direction 115. The screw rod 113 can be turned by an electromechanical device 114, such as shown in FIG. 1, or by any other power providing mechanism, such as a hand crank for manual operation. The binding roller can be a pliable material, such as a synthetic rubber, or other types of material that will apply force across the spine area of a cover. As the screw rod 113 moves the binding roller 116 along the direction 115, a force can be exerted perpendicular to the side 110 in a direction 111. As an alternative to the screw rod 113 of FIG. 1, a roller drive can be a belt, cable, hydraulic component, gears, cam arrangement or other types of mechanical mechanisms for displacing a roller (e.g., spine roller 116) along a plane (e.g., side 110) for exerting a force perpendicular to the plane (e.g. side 110) in a direction 111.

Exemplary embodiments include a cover control component operable to move within the sheet receiving volume in a direction of the first dimension of the sheet receiving volume. For example, as shown in FIG. 1, a cover roller 118 is operable to move along a direction 119 within the space 108 (i.e., between the lower clamp 104 and the upper clamp 106), in a manual or automated manner. As shown in FIG. 1, exemplary embodiments can include a cover control component that is movable into a recess of one of the first and second clamping components and is a second roller. For example, the upper clamp 106 of FIG. 1 has U-shaped recess 121 for receiving the cover roller 118.

A cover control component does not have to be configured as a second roller (i.e. a mass rotating about an axis). For example, the cover control component can be a bar with a rounded tip that will allow the flap of the cover to be inserted between a plural assembly of sheets and the rounded tip. However, if the cover control component will be used to pull a flap of a cover into a sheet receiving volume then, for example, the cover control component can be a second roller attached to a rotation drive mechanism for rotating the second control roller to pull the flap of a cover into the sheet receiving volume. As shown in the exemplary embodiment of FIG. 1, the rotation drive mechanism can be a hand wheel 120 attached to the cover roller 118. In the alternative, an electromechanical device or any other power providing mechanisms can be used to rotate a second roller for pulling the first flap of a cover into the sheet receiving volume.

In the alternative or in addition, if the cover control component will be used to push a flap of a cover out of the sheet receiving volume, then the cover control component can be a second roller attached to rotation drive mechanism for rotating the second roller to push the flap of a cover out of the sheet receiving volume. As discussed above, the rotation drive mechanism can be a hand wheel 120 attached to the cover roller 118, as shown in the exemplary embodiment of FIG. 1, a electromechanical device or any other power providing mechanism to rotate a second roller for pushing the flap of a cover and the assembly of plural sheets out of the sheet receiving volume.

Exemplary embodiments include an opposition roller to the first roller for exerting forces on both sides of a cover and the assembly of plural sheets. For example, the extraction roller 122 and the binding roller 116 in the exemplary embodiment of FIG. 1, are configured for exerting forces on both sides of a cover and the text body 112 when the text body 112 is taken out or pushed out of the apparatus 100. Subsequent disclosure in the exemplary embodiments of FIGS. 2, 3*a*-3*f* and 4*a*-4*d* will provide further details and examples of an opposition roller to the first roller for exerting forces on both sides of a cover and a plural assembly of sheets.

FIG. 2 illrstrates exemplary embodiments of steps for attaching a cover to an assembly of plural sheets in a flowchart 200. Positioning the assembly of plural sheets within a sheet receiving volume defined, at least in part, by first and second clamping components, wherein the assembly of plural sheets includes a first edge is a method step described in block 202 of FIG. 2.

Figure 3A:
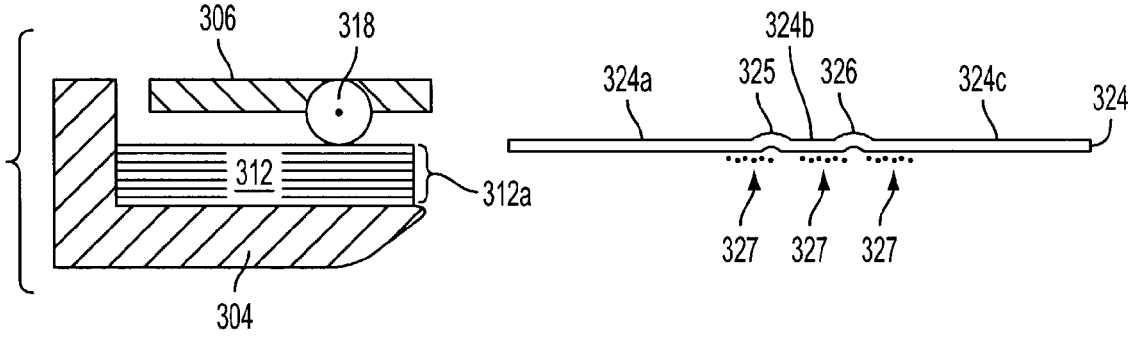

An exemplary illustration of the step in block 202 is shown with respect to an exemplary embodiment of an apparatus 300. More particularly, FIG. 3*a* shows a text body 312 having an edge 312*a*, and positioned between a lower clamp 304 and an upper clamp 306. In addition, FIG. 3*a* depicts a cover 324 with a first flap 324*a*, a spine 324*b* and a second flap 324*c*. Portions of the flaps 324*a*/324*c* and the spine 324*b* have an adhesive 327 such as, for example, a pressure sensitive adhesive. The hinges (i.e., 325 and 326) of the cover 324 are also depicted in FIG. 3. Although an adhesive is shown on the spine 324*b* of the cover 324 in FIG. 3, it is within the scope of the present invention to omit the adhesive 327 on the spine 324*b* of the cover and attach the cover 324 so that the spine 324 is a floating. In the case of a "floating spine", the text body 312 will be bound. Further, the text body 312 can be bound, regardless of whether the spine is to be floating spine.

The exemplary embodiments of FIG. 2 include a method step, as described in dashed block 204, of displacing at least a section of the assembly of plural sheets from one of the first and second clamping components upon which the assembly of plural sheets is positioned. The dashed block is indicative of a step which can be a function of the exemplary embodiment of the apparatus. More particulary, an exemplary embodiment can have a cover control component within the clamping component on which the assembly of plural sheets is positioned.

Figure 4A:
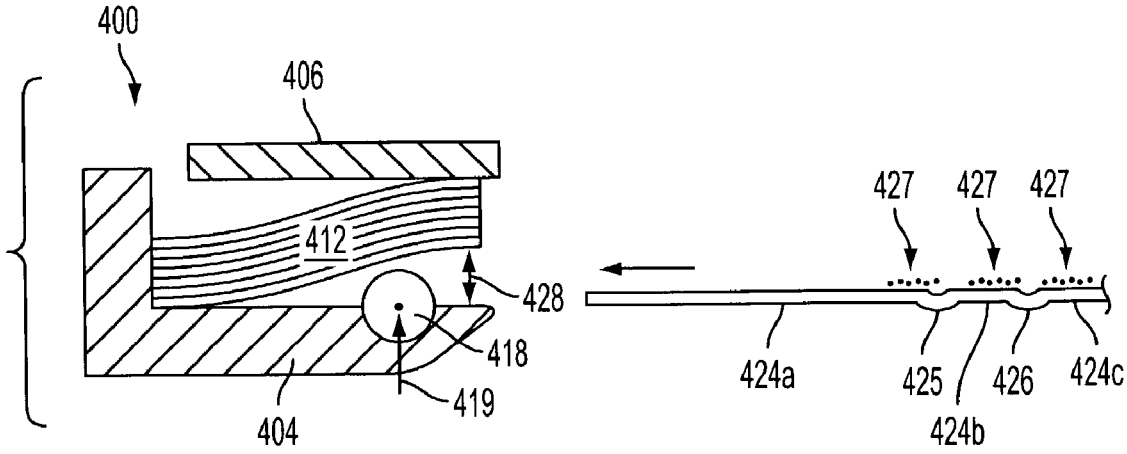

For example, an apparatus 400 of an exemplary embodiment in FIG. 4*a* shows a text body 412 positioned on a lower clamp 404 and a cover roller 418 within the lower clamp 404. Since the text body 412 is positioned on the lower clamp and the flap 424*a* of the cover 424 is to be fed between the text body 412 and the lower clamp 404, the cover roller 418 can be moved up against the text body 412 to create a nip 428 that the flap 424*a* can be fed into.

Although the method step described in dashed block 204 of FIG. 2 has been described with respect to an apparatus 400 (e.g., a cover roller 418 in a lower clamp 404) oriented in a horizontal orientation, the method step described in dashed block 204 can be used with the apparatus 400 having orientations inclined up to and including an upright orientation. This method step is also applicable to a clamping component in which the assembly of plural sheets is retained in a position by forces (e.g., a holding bar across the text) other than gravity or in addition to gravity.

Figure 3B:
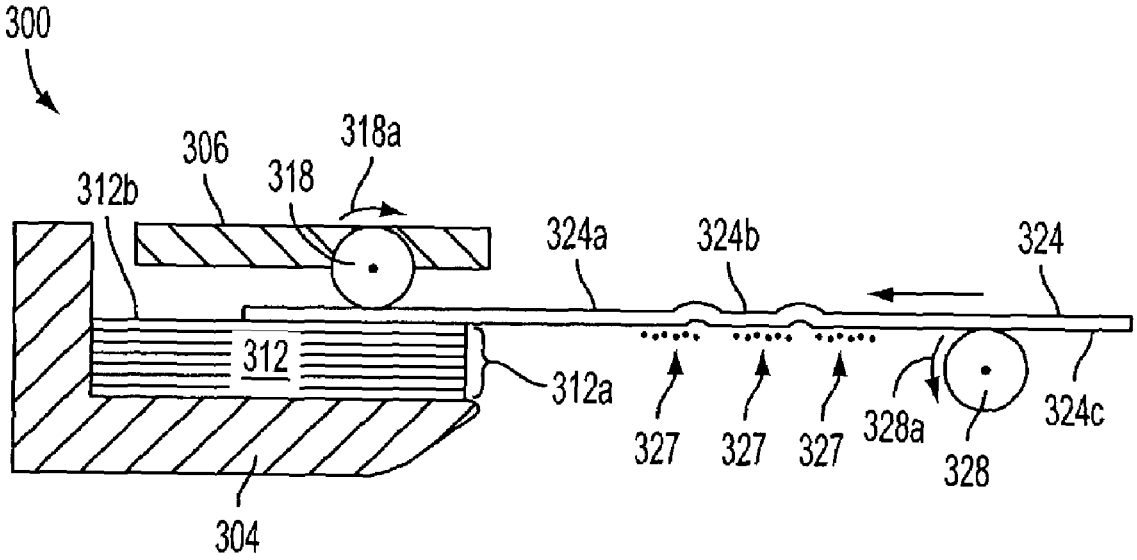
Figure 4B:
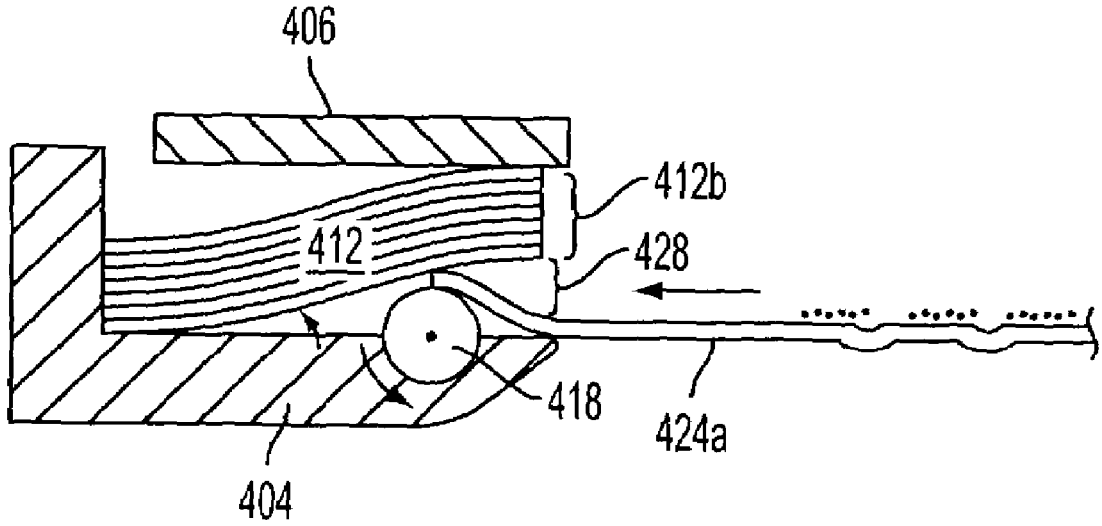

Delivering a first flap of the cover from a feed point into the sheet receiving volume such that the first flap is received by a first side of the assembly of plural sheets is illustrated as a method step in block 206 of FIG. 2. For example, as shown in FIG. 3*b*, the flap 324*a* is delivered onto a side 312*a* of the text body 312 that is between the lower clamp 304 and the upper clamp 306. In another example, as shown in FIG. 4*b*, the flap 424*a* is delivered onto a side 412*b* of the text body 412 that is between the lower clamp 404 and the upper clamp 406.

Exemplary embodiments can include delivering the first flap into the sheet receiving volume from a feed point outside of the sheet receiving volume by a feeder. For example, FIG. 3*b* illustrates a first flap (e.g., flap 324*a*) delivered into a sheet receiving volume (e.g., at a position in between the lower clamp 304 and upper clamp 306) by a feeder (e.g., feed roller 328), which is at a feed point. FIG. 3*b* illustrates that the feed can, but need not be, at a position between the lower clamp 304 and upper clamp 306. In addition or in the alternative, exemplary embodiments can include delivering the first flap within the sheet receiving volume by pulling the first flap into the sheet receiving volume with a cover control component.

As shown in the exemplary embodiment of FIG. 3*b*, the cover roller 318 rotates in a direction 328*a* to pull the flap 324*a*, while a feed roller 328 rotates in a direction 328*a* to move (e.g., push) the cover 324. In an alternative, the feed roller 328 can be used to insert a flap 324*a* just to the cover roller 318, and then the cover roller 318 can be powered to pull the flap 324*a* in a direction 318*a* to complete delivery of the flap 324*a*. A feeder is not necessarily a roller, such as feed roller 328, but can be done manually by an operator, or using any other conveying mechanism.

The exemplary embodiments of FIG. 2 can include an alternative method step, as illustrated in dashed block 208, of displacing at least one of the feed point and the sheet receiving volume while delivering a first flap of the cover into the sheet receiving volume, such that at least a section of the first flap is separated from the first side.

Figure 3C:
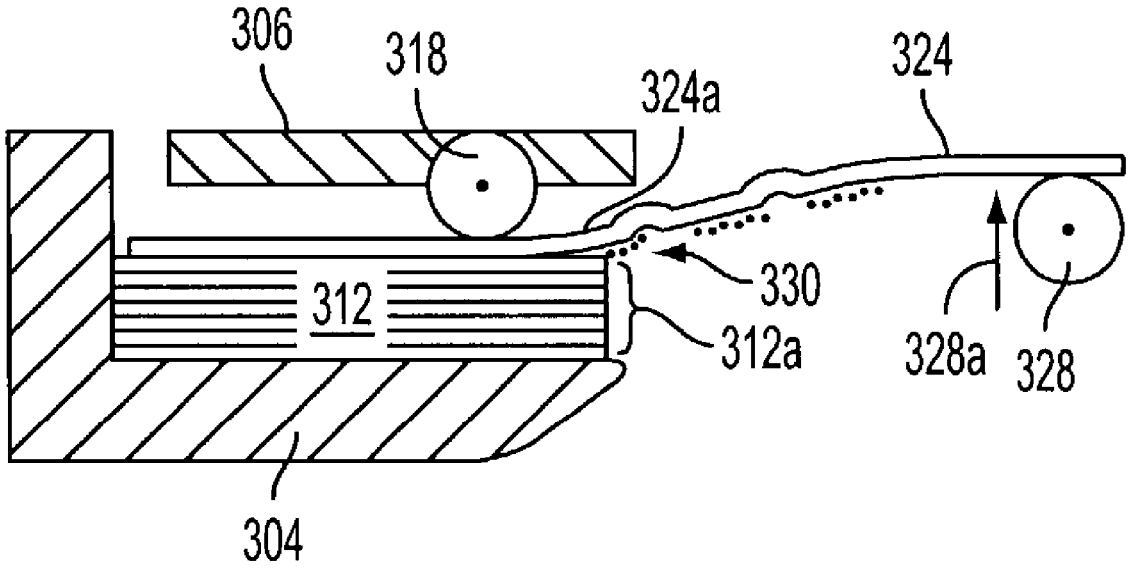
Figure 4C:
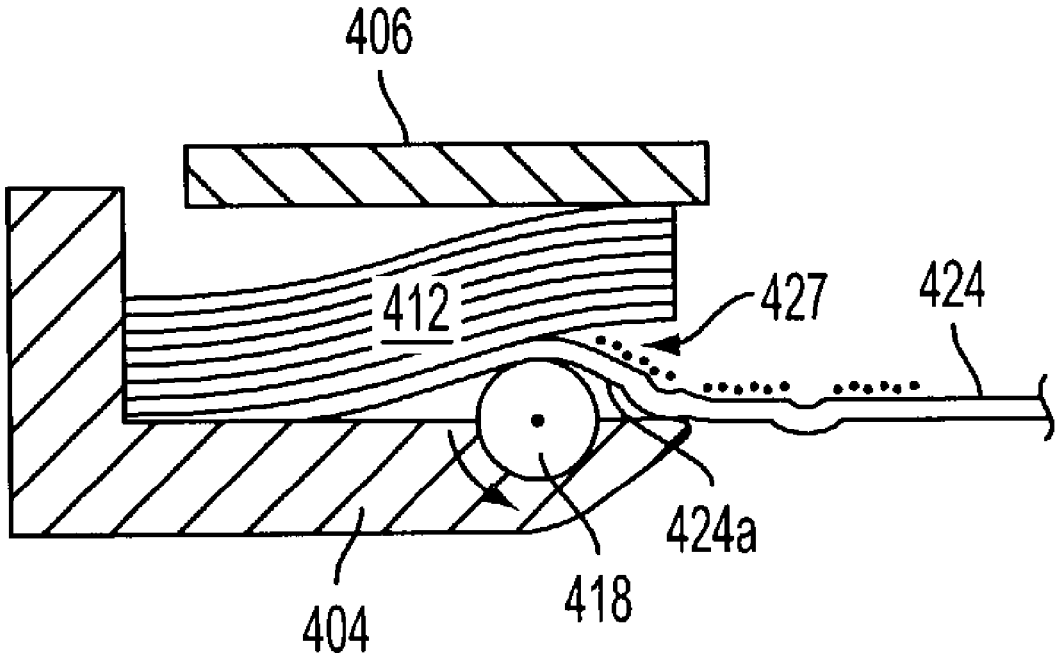

Use of the dashed block can be selected as a function of the exemplary embodiment of the apparatus chosen. For example, as shown in FIG. 3*b*, the cover is fed onto a side 312*a* of a text body 312 that is substantially in the same plane as the cover 324 from the feed roller 328. As referenced herein, "substantially" means that the text body is sufficiently aligned with the desired feeding of the cover to properly receive the cover during operation. As shown in FIG. 3*c*, to prevent the adhesive element 327 on the flap 324*a* from bonding to the text body prior to complete delivery of the cover 324, the feed roller 328 can be displaced along a direction 328*a*, or along any desired direction, while delivering the cover 324. In the FIG. 3*c* embodiment, the movement used to displace the feed roller 328 creates a space 330 that separates a section of the flap (e.g., the section of the flap with the adhesive element) from the first side 312*a* of the text body 312. In addition or in the alternative, the sheet receiving volume (e.g., both clamps 304/306 or the clamp on which the text body is positioned) can be displaced to affect (e.g., enlarge or reduce) the space 330 that separates a section of the flap from the first side 312*a* of the text body 312. FIG. 4*c* shows how an exemplary displacement of the cover roller 418 can be used to enable complete delivery of the cover 424 such that the adhesive 427 on the flap 424*a* is not in contact with a section of the text body 412.

Figure 3D:
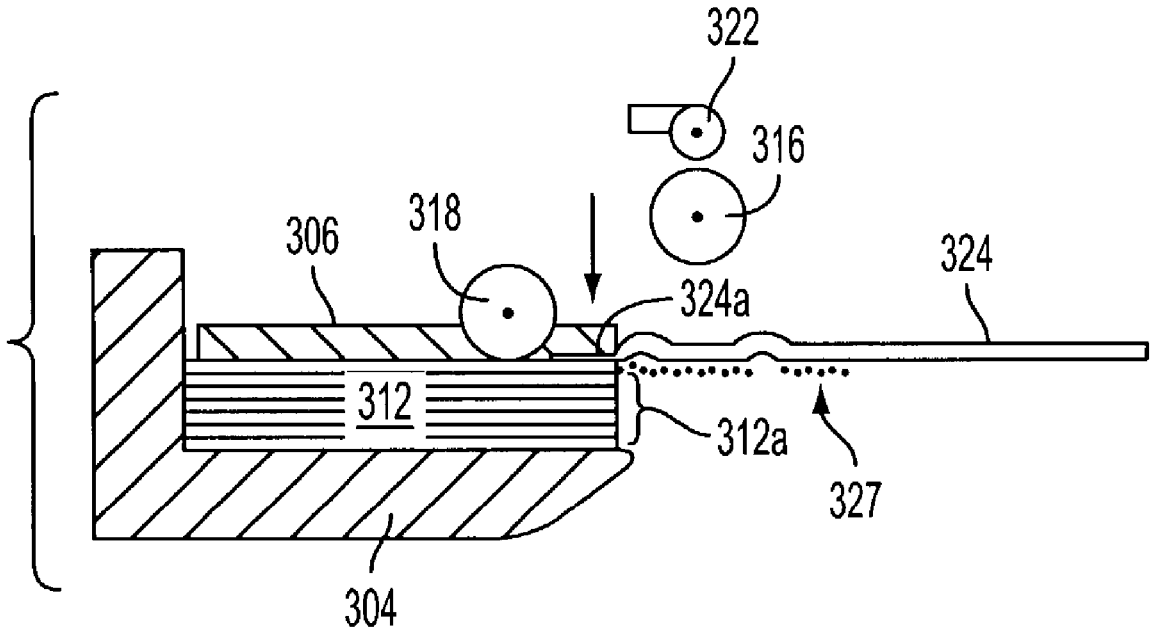
Figure 4D:
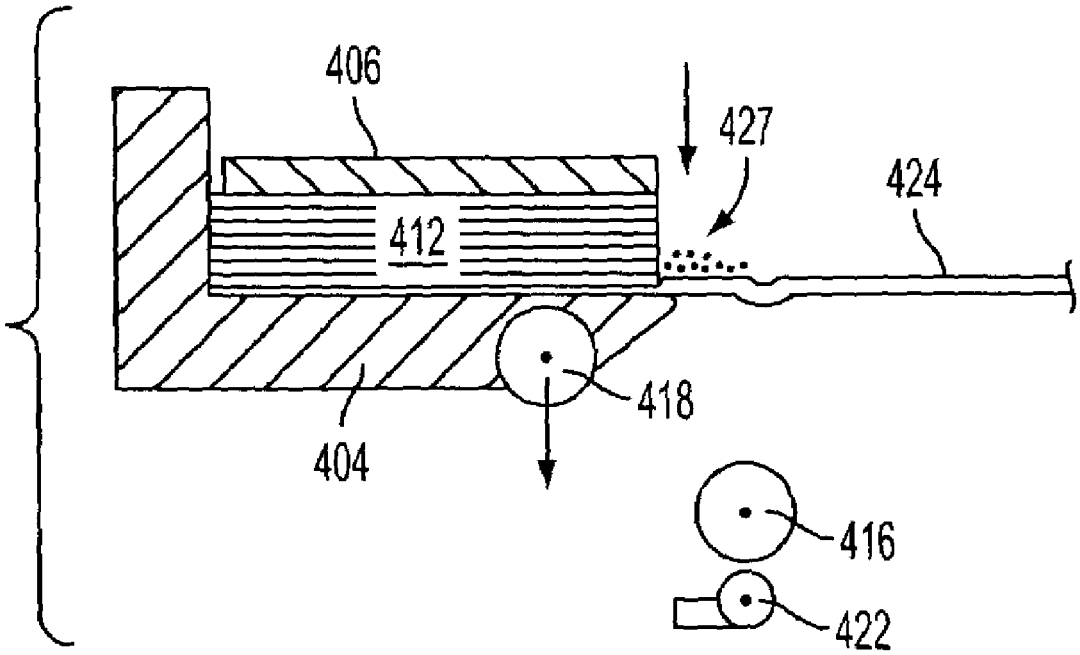

The FIG. 2 method step 210 illustrates an exemplary clamping of the assembly of plural sheets and the first flap with the first and second clamping components. For example, as shown in FIG. 3*d*, the upper clamp 306 is moved down to exert pressure on both the text body 312 and the flap 324*a* to attach the first side of the text body 312 to the flap 324 with the adhesive 327. Similarly, FIG. 4*d* illustrates the upper clamp 406 being moved down to exert pressure on both the text body 412 and a flap of the cover 424 to attach the text body 412 to the cover 424.

Figure 3E:
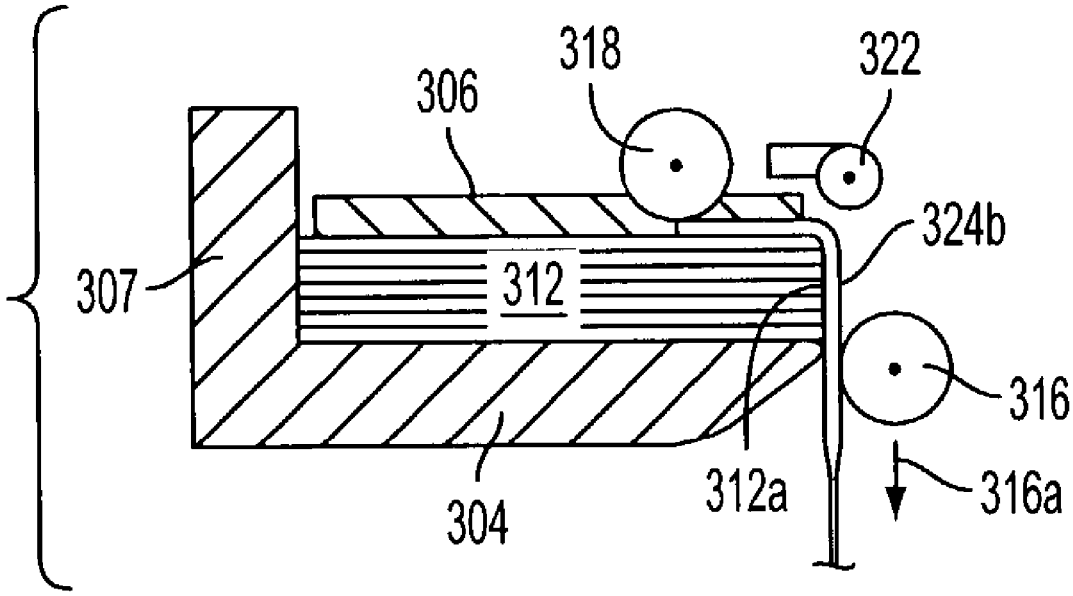

Subsequent to clamping, as illustrated in method step 212 of the exemplary embodiments in FIG. 2, a first roller can be displaced along a first plane of the sheet receiving volume such that a spine of the cover is pressed against the first edge, wherein the first plane is positioned orthogonal to the first and second clamping components. FIG. 3*e* illustrates a spine roller 316 that has rolled down in a direction 316*a* so as to press the spine portion 324 in a direction against the edge 312*a* of the text body toward the jog 307. In the example of FIG. 3*e*, the spine 324*b* of the cover 324 is attached to the edge of the text body 312, since adhesive 327 had been applied to the spine 324*b* of the cover 324. Then, the text body 312 and the flap 324*a* are unclamped.

Figure 3F:
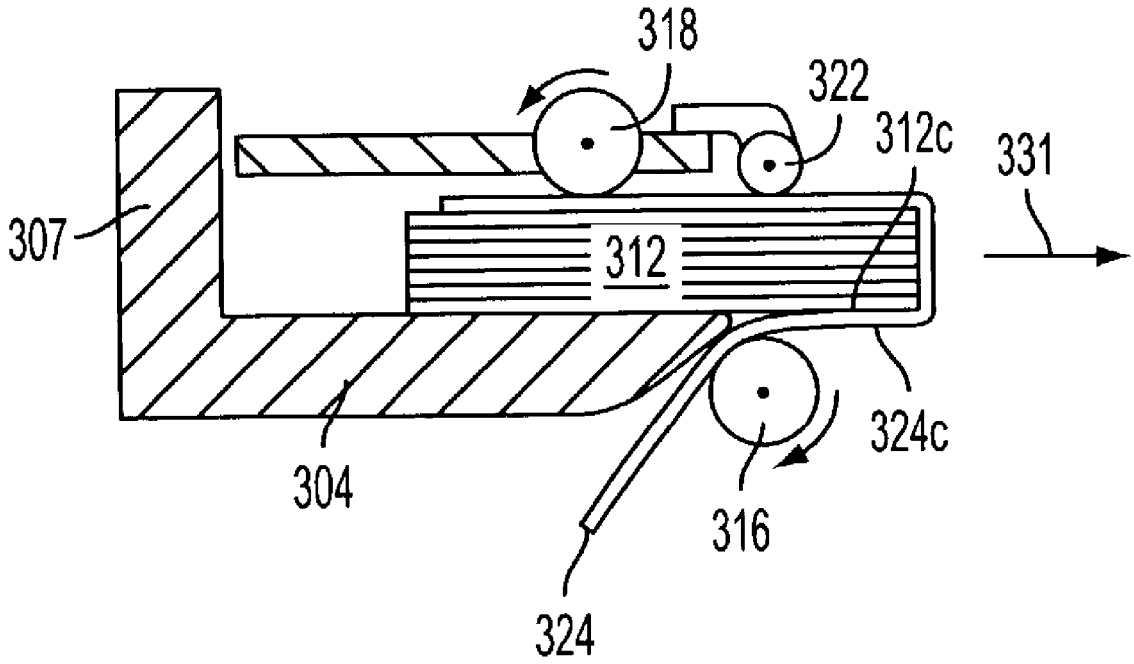

The exemplary embodiments of FIG. 2 include a method step 214 for transporting the assembly of plural sheets and first flap out of the sheet receiving volume such that the first roller presses a second flap of the cover against a second side of the assembly of plural sheets. For example, FIG. 3*f* illustrates the cover control component (e.g., cover roller 318) within the sheet receiving volume (e.g., space between the lower clamp 304 and upper clamp 306) pushing to eject the assembly of plural sheets (e.g., text body 312) and first flap (e.g., flap 324*a*) out of the sheet receiving volume in the direction 331. In the alternative, the text body 312 with the attached cover 324 can be withdrawn from manually.

FIG. 3*f* illustrates that as the text body 312 with the attached cover 324 is withdrawn, the spine roller 316 can be configured to press a flap 324*c* of the cover 324 against a side 312*c* of the text body 312. The first flap (e.g., flap 324*a*), second flap (e.g., flap 324*c*) and the assembly of plural sheets (e.g., text body 312) can be pressed between a third roller (e.g., ejection roller 322) and the first roller (e.g., spine roller 316) while transporting the assembly of plural sheets and first flap out of the sheet receiving volume.

It will be appreciated by those of ordinary skill in the art that the present invention can be embodied in various specific forms without departing from the spirit or essential characteristics thereof. The presently disclosed embodiments are considered in all respects to be illustrative and not restrictive. The scope of the invention is indicated by the appended claims, rather than the foregoing description, and all changes that come within the meaning and range of equivalence thereof are intended to be embraced.

What is claimed is:

1. An apparatus for attaching a cover to an assembly of plural sheets, comprising:

first and second clamping components displaceable relative to one another, wherein the first and second clamping components define a first dimension of a sheet receiving volume, and wherein a second dimension of the sheet receiving volume is defined by a sheet stop and a first plane that is orthogonal to the first and second clamping components; and a roller drive for displacing a first roller along the first plane and exerting a force perpendicular to the first plane in a direction toward the sheet receiving volume.

2. The apparatus of claim 1, comprising:

an opposition roller to the first roller for exerting forces on both sides of a cover and the assembly of plural sheets.

3. The apparatus of claim 1, comprising:

a feeder positioned outside of the sheet receiving volume for delivering a first flap into the sheet receiving volume.

4. An apparatus for attaching a cover to an assembly of plural sheets, comprising:

first and second clamping components displaceable relative to one another, wherein the first and second clamping components define a first dimension of a sheet receiving volume, and wherein a second dimension of the sheet receiving volume is defined by a sheet stop and a first plane that is orthogonal to the first and second clamping components;

a roller drive for displacing a first roller along the first plane and exerting a force perpendicular to the first plane in a direction toward the sheet receiving volume; and a cover control component operable to move within the sheet receiving volume in a direction of the first dimension.

5. The apparatus of claim 4, wherein the cover control component is movable into a recess of one of the first and second clamping components.

6. The apparatus of claim 4, wherein the cover control component is a second roller.

7. The apparatus of claim 4, wherein the cover control component is a second roller attached to a rotation drive mechanism for rotating the second roller to pull a first flap of the cover into the sheet receiving volume.

8. The apparatus of claim 4, wherein the cover control component is a second roller attached to a rotation drive mechanism for rotating the second roller to push a first flap of the cover out of the sheet receiving volume.

9. The apparatus of claim 4, wherein the cover control component is a second roller attached to a rotation drive mechanism for rotating the second roller to pull a first flap of the cover into the sheet receiving volume, or push a first flap of the cover and the assembly of plural sheets out of the sheet receiving volume.

10. A method for attaching a cover to an assembly of plural sheets, comprising the steps of:

positioning the assembly of plural sheets within a sheet receiving volume defined, at least in part, by first and second clamping components, the assembly of plural sheets including a first edge;

delivering a first flap of the cover from a feed point into the sheet receiving volume such that the first flap is received by a first side of the assembly of plural sheets;

clamping the assembly of plural sheets and the first flap with the first and second clamping components; and displacing a first roller along a first plane of the sheet receiving volume such that a spine of the cover is pressed against the first edge, wherein the first plane is positioned orthogonal to the first and second clamping components.

11. The method of claim 10, wherein the spine portion includes an adhesive element.

12. The method of claim 10, wherein the first flap includes an adhesive element.

13. The method of claim 10, wherein the first flap is delivered into the sheet receiving volume by a feeder outside of the sheet receiving volume.

14. The method of claim 10, wherein delivering the first flap includes a cover control component within the sheet receiving volume pulling the first flap into the sheet receiving volume.

15. The method of claim 10, comprising the step of:

displacing at least a section of the assembly of plural sheets from one of the first and second clamping components.

16. The method of claim 10, comprising the step of:

displacing at least one of a feed point and the sheet receiving volume while delivering a first flap of the cover into the sheet receiving volume such that at least a section of the first flap is separated from the first side.

17. The method of claim 10, comprising the step of:

transporting the assembly of plural sheets and first flap out of the sheet receiving volume such that the first roller presses a second flap of the cover against a second side of the assembly of plural sheets.

18. The method of claim 17, wherein a cover control component within the sheet receiving volume pushes the assembly of plural sheets and first flap out of the sheet receiving volume.

19. The method of claim 17, wherein the first flap, second flap and the assembly of plural sheets are pressed between a third roller and the first roller while transporting the assembly of plural sheets and first flap out of the sheet receiving volume.

* * * * *